United States Patent [19]

Schmidt

[11] Patent Number: 4,497,254

[45] Date of Patent: Feb. 5, 1985

[54] ISOLATING DEVICE FOR AN OPENING TRAVERSED BY CONVEYOR CARS

[75] Inventor: Siegfried Schmidt, Olching, Fed. Rep. of Germany

[73] Assignee: Büropatent AG, Glarus, Switzerland

[21] Appl. No.: 421,396

[22] Filed: Sep. 22, 1982

[30] Foreign Application Priority Data

Oct. 7, 1981 [CH] Switzerland ..... 6434/81

[51] Int. Cl.[3] ..... B61B 12/00; E06B 7/00

[52] U.S. Cl. ..... 104/1 R; 49/69; 198/950; 238/10 R

[58] Field of Search ..... 104/1 R, 1 B, 88, 93, 104/100, 103; 198/950; 49/68, 69, 262; 414/154; 238/10 R

[56] References Cited

U.S. PATENT DOCUMENTS

| | | | |
|---|---|---|---|
| 941,805 | 11/1909 | Neller | 104/100 |
| 1,466,365 | 8/1923 | Krump | 104/100 |
| 1,550,141 | 8/1925 | Bennington | 104/100 X |
| 1,729,449 | 9/1929 | Nagy | 104/93 |
| 3,125,232 | 3/1964 | Brinkman et al. | 49/68 X |
| 3,630,439 | 12/1971 | Cook | 104/103 |
| 3,795,199 | 3/1974 | Herzog | 104/100 |
| 4,003,714 | 1/1977 | Foglino et al. | 49/68 X |

FOREIGN PATENT DOCUMENTS

| | | | |
|---|---|---|---|
| 2543744 | 4/1977 | Fed. Rep. of Germany | 49/68 |
| 2734641 | 2/1979 | Fed. Rep. of Germany | 49/68 |
| 62874 | 5/1977 | Japan | 198/950 |

*Primary Examiner*—Randolph Reese
*Attorney, Agent, or Firm*—Karl F. Ross

[57] ABSTRACT

An isolating device for an opening in a wall traversed by a track for vehicles of a conveyor system. A door can swing up or down to close this opening and a removable track section can be drawn in the direction of the track to clear a path for the door.

13 Claims, 10 Drawing Figures

ISOLATING DEVICE FOR AN OPENING TRAVERSED BY CONVEYOR CARS

SPECIFICATION

1. Field of the Invention

The present invention relates to an isolating device for blocking off a wall opening traversed by conveyor cars and, more generally, to a system in which a conveyor track passes through an opening in a wall which must be closed, e.g. automatically, by a door or the like to isolate one side of this wall from the other.

2. Background of the Invention

For fire safety and other reasons, doorways, wall openings and the like have frequently been provided with automatic door-closing devices to shut the opening under emergency conditions and thereby isolate one side of the wall provided with this opening from the other.

While such devices, hereinafter referred to as isolating devices, utilizing fire-retardant doors, for example, are widely used in structure to separate parts of corridors from each other, to isolate stairwells and, more generally, block a dangerous condition on one side of the opening from spreading to the other side thereof, in most cases there are few limits as to the way in which a door or barrier can move to accomplish the isolating operation.

However, in the case of conveyor systems in which, for example, a conveyor track traverses a wall which is to be provided with an isolating device, e.g. for the passage of cars or other vehicle along this track, the problem of isolation is complicated by the presence of the track.

In German Pat. No. 27 34 641, this problem is dealt with in an isolating device for the wall opening of a conveyor having a track by providing for the removal of a portion of the track upon closure of the door out of the conveyor plane as the door is closed.

In this arrangement, the door is displaced laterally, up or down, perpendicular to the direction of travel of the conveyor and the track direction across the opening and a very short section of the track, generally corresponding in length to the thickness of the door, is correspondingly shifted laterally out of the way to allow such closure.

While this system is effective to isolate one side of the wall from the other by blocking the opening traversed by the conveyor, the device which is used is relatively complex and expensive and, because of its complexity, is prone to failure or may require considerable maintenance.

OBJECTS OF THE INVENTION

It is, therefore, a principal object of the present invention to provide an improved isolating device for a system in which a track or rail traverses the opening, whereby the disadvantages of earlier systems, such as the one described above, can be obviated.

Another object of the invention is to provide an isolating device for a wall opening of a conveyor which is simple, occupies less space than earlier systems, does not require lateral displacement of the door and of the track and hence large amounts or room around the opening, and, finally, which requires less maintenance than the earlier systems.

Still another object of this invention is to provide a relatively low-cost but highly effective isolating device capable of emergency isolation of one side of a track conveyor system from another side hereof whereby the two sides are separated by an opening traversed by a track.

SUMMARY OF THE INVENTION

These objects and others which will become apparent hereinafter are attained, in accordance with the invention, by providing an isolating device for a wall opening traversed by a conveyor track, the isolating device having a swingable door hinged to the wall at a location offset from the opening and being operatively connected to a section of the track so that the latter is displaced generally in the direction in which the track extends upon swinging movement of the door into its closed position.

This arrangement allows the lateral space requirements of the isolating device in or on the wall to be comparatively small and indeed, by causing the movable cross section to fold within the wall opening, limits the space required to the opening itself and its adjoining frame (at which the swingable door is mounted).

Furthermore, the closing of the opening by the door, which displaces the movable track section in the direction of the track and preferably folds it within the opening, permits the door to overlap all of the perimeter of the opening and thereby greatly improves the barrier effect of the door. The closing device itself is greatly simplified since it does not require massive peripheral structures for the door or the path of the latter between its open and closed positions.

Naturally, the reference to the "opening" in the wall is intended to include any doorway, aperture or other passage in a structure traversed by a track and the "wall" can of course be a vertical or inclined member separating one space from another, a floor, a ceiling or roof, or any other element which is provided between spaces to be isolated and which is traversed by a conveyor or like track.

Preferably, the swinging door is hinged to the frame surrounding the doorway above the conveyor plane. When the conveyor path is horizontal or slightly inclined to the horizontal, this arrangement enables the weight of the door to facilitate or effect the closing thereof without requiring other motive means for this purpose.

Of course, the door can be hinged below the path of the conveyor, whereupon the drive means is required to close the door by swinging it upwardly, although the opening of the door is facilitated because gravity can be used for this purpose.

While the isolating device is primarily intended to separate two spaces in an emergency situation, e.g. in a fire, the swingable door can be provided with a drive mechanism to open or close the door. This is especially important when the door is to have a function even in non-emergency situations in which opening and closing operations are not occasional but rather may be frequently repeated.

In some cases, for example, the wall opening can be kept closed by the door until the conveyor vehicle approaches, can then be opened to permit the passage of the vehicle, and thereafter can be closed. Conversely, the door can be normally open and can be closed, e.g. when the conveyor system is shut down.

It has been found to be advantageous to provide the swingable door with a conventional door closer, i.e. a fluid-operated rotary damper, having an articulate arm connected therewith, prestressed so that it tends to close the door. Under these circumstances the door may be held in its open position against the doors of the door closer, preferably by an electro-magnetic latching device.

This arrangement has been found to be particularly desirable for an isolating device for emergency closure in the event of fire such that the door functions as a fire barrier.

The movable track section, according to the invention, can be shiftable over a stationary track section, preferably with the aid of guide surfaces upon which the movable track section can be cammed upwardly, greatly simplifying the mechanism. However, less space is needed when the movable track section is folded, as previously mentioned, as it is drawn away from its normal position into the closed position of the door.

The two or more sections of the track which are to be folded can be pivotally connected and a traction element, such as a traction cable, spring band or the like can be provided to assist in folding or stretching out the folded section, respectively. When a flexible member is provided, an additional opening may be required in the wall for this member. When the mechanism coupling the door to be movable track section includes a rod or bar connected to another bar of the door by a rod which is hinged to the bars, no extra opening in the door or the wall is required.

The arrangement can be such that the movable track section lies against the swingable door and at the end of the door opposite the hinge, a connecting member can be provided in a linear guide structure for the swingable door. Of course, three or more mutually pivotable track members can form a movable track section and can lie in a zigzag configuration when the door is closed.

According to another feature of the invention, the movable track section is held by retaining or detent device in the working position, preferably by being prestressed against this detent arrangement so as to tend to fold into the closed position or to shift into a position in which the movable track section overlies a stationary track section.

A particularly effective prestressing arrangement for this purpose utilizes a hinge drum formed with a spiral spring. When the retaining arrangement is a magnetic device, it does not, upon being inactivated, impose any barrier to the closing operation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
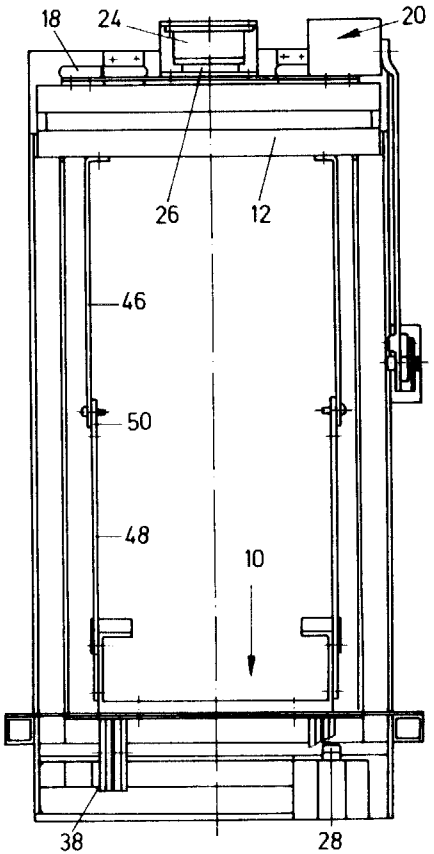
FIG. 2 is a section taken along the line II—II of FIG. 1.

In FIGS. 1–4, there is shown an isolating device in accordance with the invention in which an opening 2 is provided in a wall 4 separating a space to the right of this wall from a space to the left thereof. This opening 2 is traversed by a conveyor which comprises a rail system 6, 8, 10 which defines a track or path for vehicles of the conveyor system which pass along the track as represented by the arrow A. The vehicles have not been shown but can be cars or carriages which can be provided with destination codes, can carry goods or other articles, and which can form part of a comprehensive conveyor system.

The device of the invention is intended to close the opening 2 and isolate the two sides of the wall 4 from one another, e.g. as a fire-retardant barrier or the like.

The track comprises two fixed rail or track sections 6, 8, disposed to opposite sides of the opening, and a movable track section 10 located between these stationary track sections.

In the embodiment illustrated, these track sections have rail profiles and form a channel (see FIG. 2) in which wheels of the vehicles can be guided. Other rail profiles can, of course, be utilized.

Figure 1:
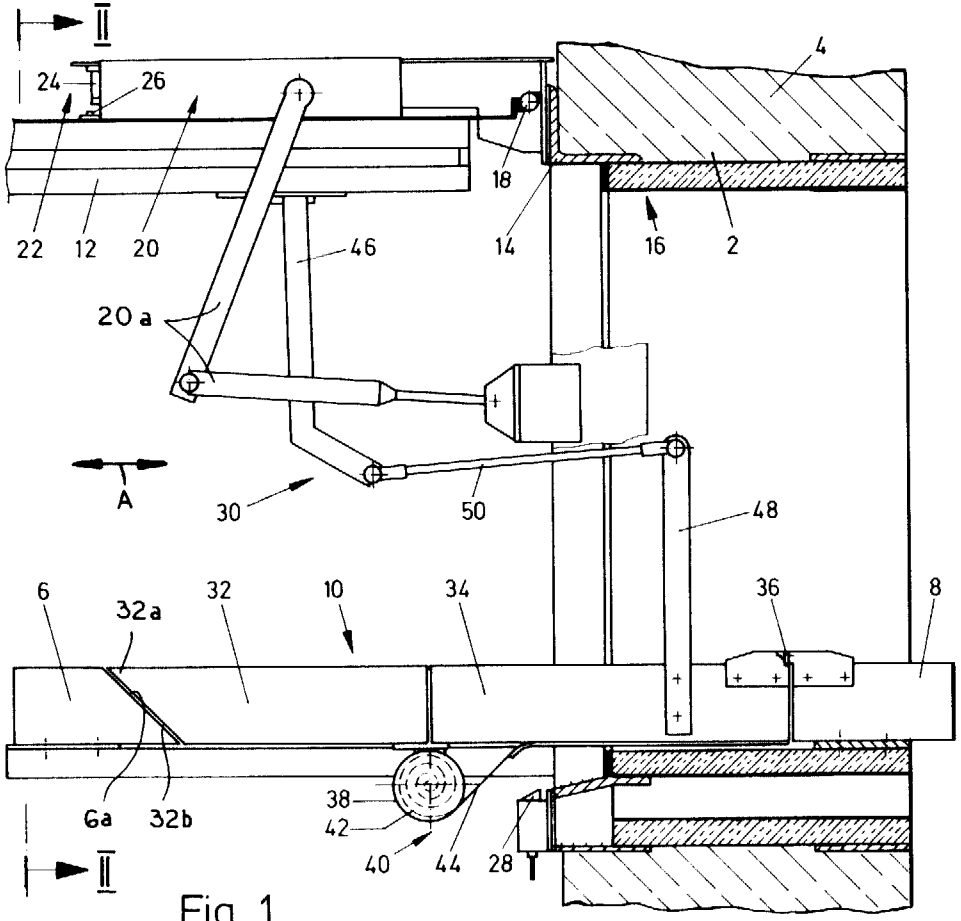
FIG. 1 is a vertical section through a portion of a conveyor system illustrating an isolating device in accordance with the invention in side elevation, partly broken away and with the door in its open position.

According to the invention, the isolating device comprises a swingable door 12 which can be fire resistant, e.g. composed of a refractory material and/or laminated from steel and insulating material. The door 12 is hinged at 18 to the upper member 14 of a frame 16 extending around the opening 2. Thus, in its open position, the door 12 can be swung upwardly out of the path of vehicles traversing the track and the opening as shown in FIG. 1.

The swinging door 12 is prestressed in the door-closing direction by a door closer 20 of conventional design connecting this door with the frame adjacent the same. As is conventional, the door closer comprises an articulated arm 20*a* which is pivotally connected to a dash pot within the door closer 20, the latter having a spring or other force-storing device for urging the door into its closed position.

To releasably retain the door in its open position, a retaining means generally represented at 22 is provided. In the embodiment of FIGS. 1–4, this retaining means comprises an electromagnet 24 which, attractively holds a ferromagnetic portion of the door as long as the electromagnetic is energized and thereby supports the door in its open position (FIGS. 1 and 2).

This retaining means 22 is mounted on a bracket 22*a* secured to the upper frame member 14 of the frame.

The ferromagnetic body on the door is shown to be a plate 26.

When a pulse is delivered to the electromagnet 24, e.g. an alarm pulse from a fire alarm or like warning device, the electromagnet 24 is deenergized and the door 12 closes under the preload of the door closer 20 and gravity.

The frame 16 which extends all around the opening 2 is overlapped all around the door 12 by a flange of the latter as represented at 12*a*, for example. A snap detent 28 (FIGS. 1 and 3) which can be released by a cable or electrical signal, locks the door in its closed position (see FIG. 3). The detent 28 is spring loaded against the force of the cable or the electrical signal.

When the emergency is over, with release of the detent 28 and reenergization of the electromagnet 24, the door can be raised to its open position (FIG. 1) and retained in this position during normal operation of the conveyor device.

The door 12 is connected via a linkage 30 with the movable track section 10, this linkage being designed to remove the movable track section and place it over the stationary track section 8 within the door opening, thereby aligning the door 12 to swing closed through the space previously occupied by the movable track section. The latter comprises two track segments 32 and 34 which are articulated to one another. The segment 34 is also pivotally connected at a hinge 36 with the stationary track section 8. The free end 32*a* of the other segment 32 has a bevel 32*b* complementary to and overlying bevel 6*a* of the stationary track section 6.

The articulation between the segments 32 and 34 is represented at 38 and includes a biasing device 40 tending to yieldably stress the articulated segments 32 and 34 and the entire section 10 so as to maintain it in its extended horizontal position shown in FIG. 1. This device 40 thus provides a bias, when the movable section is folded, tending to replace the movable section in its operative position.

Figure 1A:
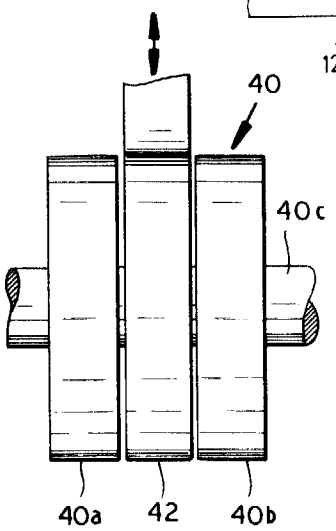
FIG. 1*a* is a detailed view of a spring hinge arrangement of FIG. 1.

The device comprises a hinge drum and utilizes a spiral spring as shown in FIG. 1*a*. In this illustration, given by way of example, one drum section 40*a* can be affixed to a shaft 40*c* and is welded to the segment 32 while the other section 40*b* can rotate freely on the shaft 40*c* and is welded to segment 34 while the spiral spring 42 has its innermost end secured to the shaft 40*c* and connected as will be described to the stationary track section. Since the spiral spring is originally under prestress and this stress increases as the segment 34 swings in the clockwise sense about the hinge 36 and the segment 32 swings in the counterclockwise sense about the hinge 38, the spring tends to draw the hinge 38 downwardly and to the left from the folded position shown in FIG. 3.

The spiral spring 42 is connected by a traction cable with the stationary track section 8 and passes around the movable track section along the side thereof turned away from the hinge 36.

As a consequence the prestress of the spiral spring is effective both between the section 34 and the stationary section 8 and between the two sections 32, 34 tending to restore the section 10 to its operative position (FIG. 1).

The linkage 30 between the swinging door 12 and the movable track section 10 comprises a bar 46 which is fixed to the underside of the door 12 (as seen in its open position in FIG. 1) and which is articulated to a link 50, the latter being pivotally connected to another bar 48 rigid with the track segment 34.

Figure 4:
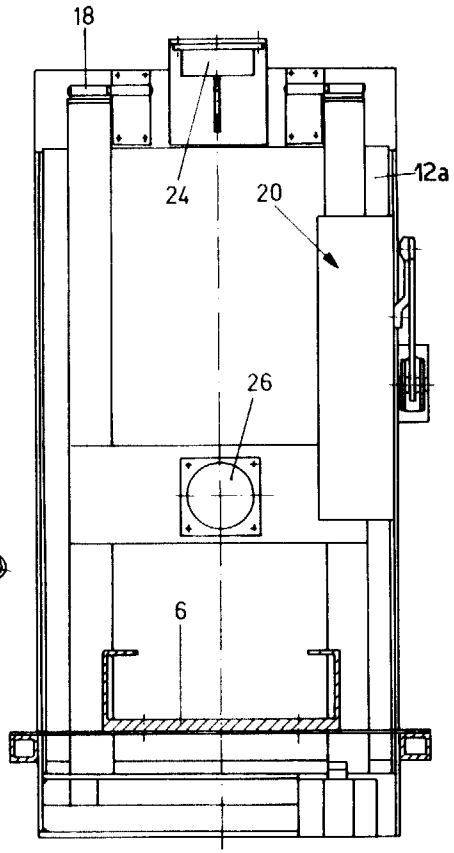
FIG. 4 is a section taken along the line IV—IV of FIG. 3.
Figure 3:
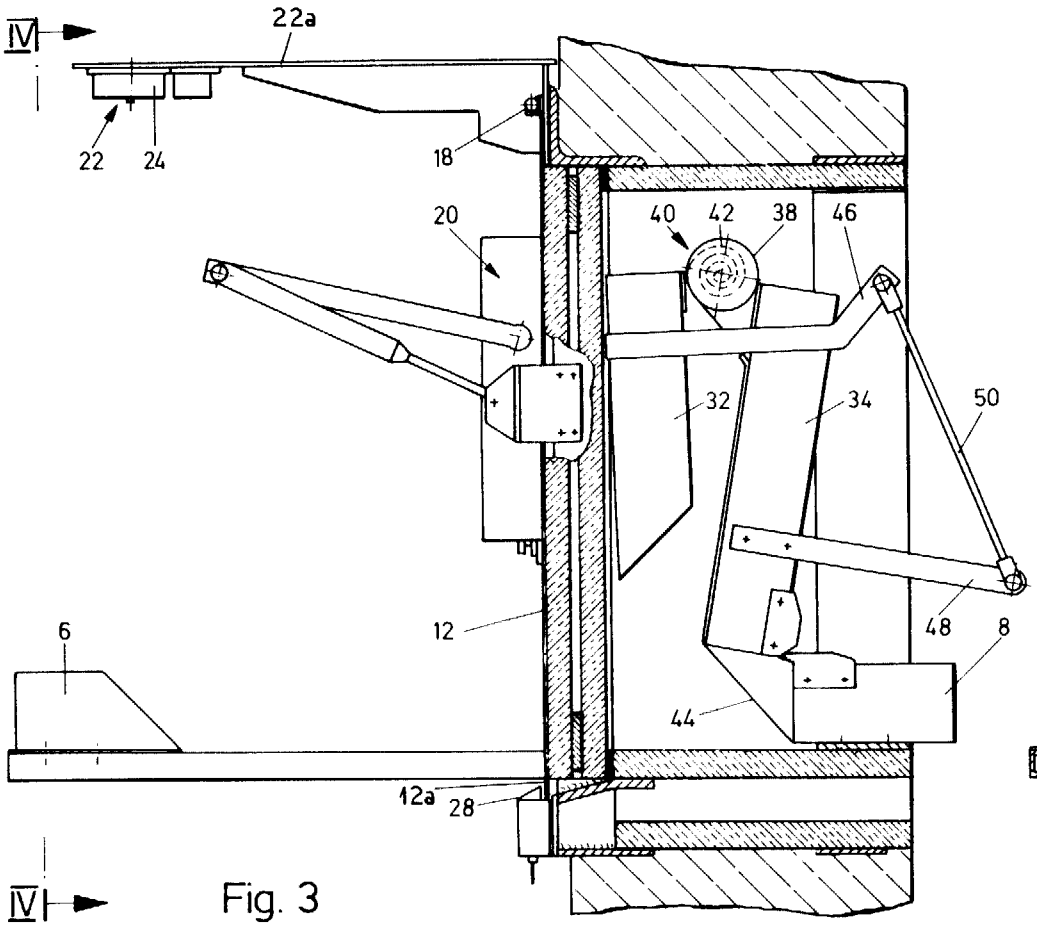
FIG. 3 is a view similar to FIG. 1 but showing the door in its closed position.

Thus, as the door 12 swings in the counterclockwise sense about its hinge 18, the bar 46 will swing inwardly to the right, thereby rotating the segment 34 in the clockwise sense about the hinge 36 and folding the movable track section into the opening as shown in FIGS. 3 and 4.

Figure 5:
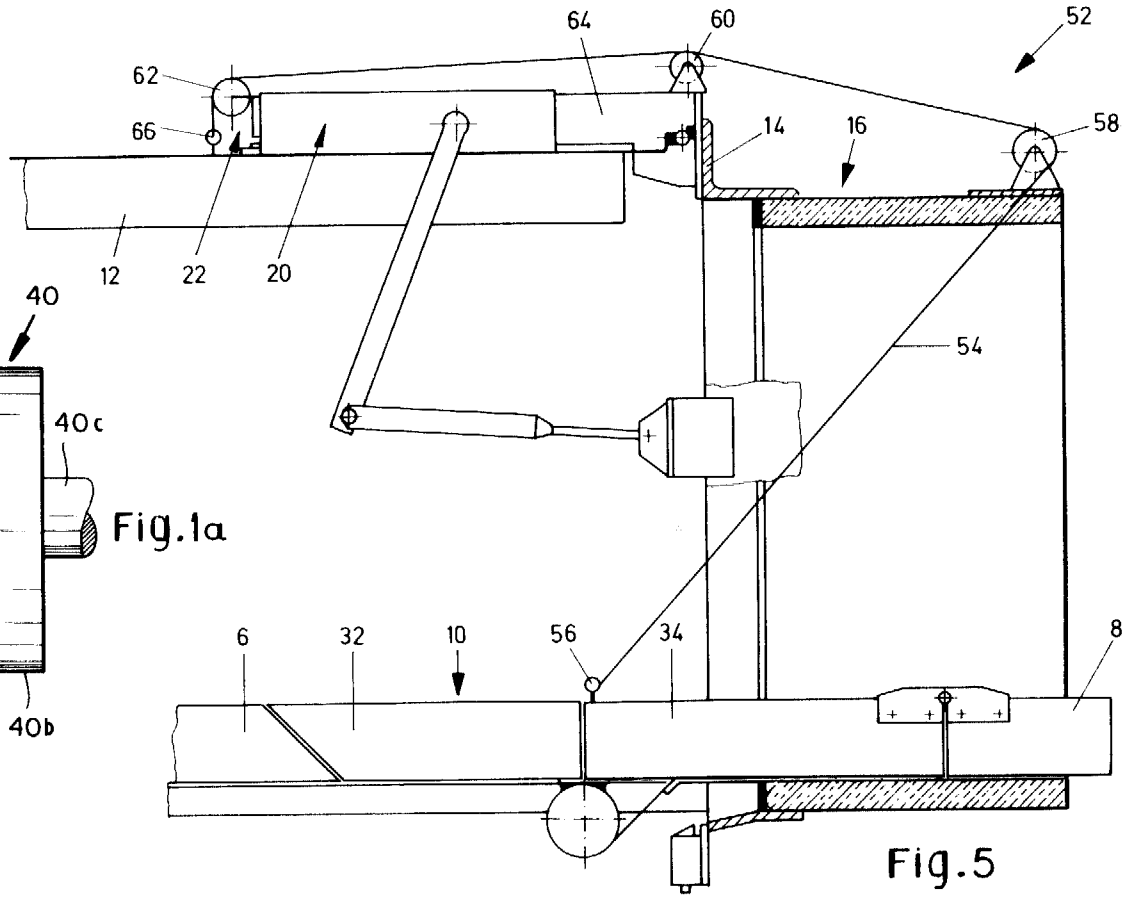
FIG. 5 is another vertical section through a portion of the conveyor in accordance with another embodiment of the invention showing the door in its open position.

FIG. 5 shows an isolating device according to the invention which is similar in operation to that of FIGS. 1–4 but utilizes a different linkage. Hence similar reference numerals are utilized to refer to similar structural elements.

In this embodiment, the linkage 52 comprises a cable 54 which is affixed at 56 to the track segment 34 at an eye. The cable 54 then passes over idler rollers 58, 60 and 62 to an eye 66 on the door 12. The roller 62 is provided at the end of the bracket or outrigger 64.

Upon closure of the door 12, the segment 34 is lifted and the movable track section 10 thereby swung into its loaded position within the door (compare FIG. 3).

Figures 6, 7:
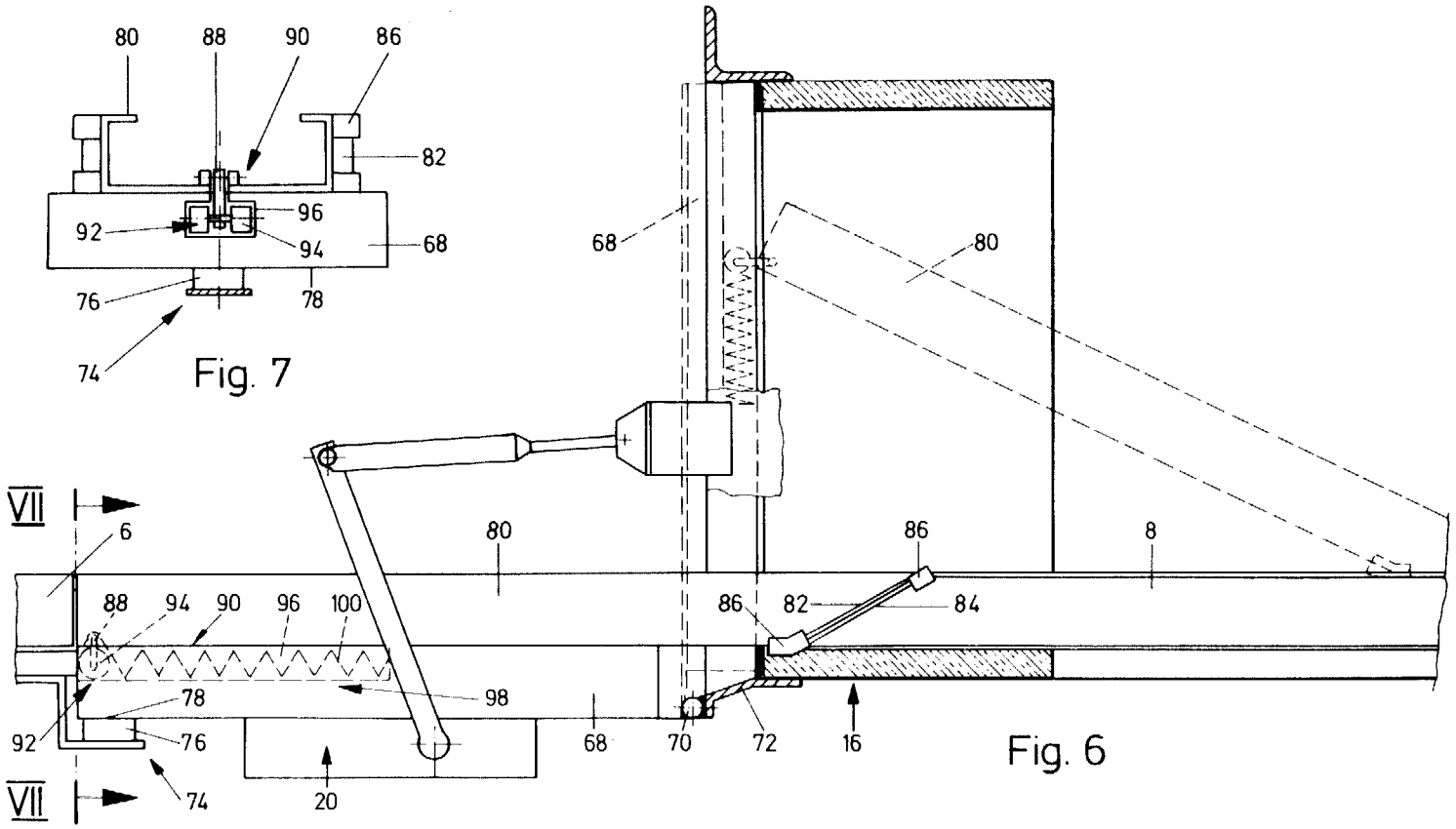
FIG. 6 is yet another fragmentary vertical section through an isolating device in accordance with the invention wherein, however, the door is hinged below the vehicle path of the conveyor, the door also being illustrated in its open position.
FIG. 7 is a section taken along the line VII—VII of FIG. 6.

A further isolating device has been shown in FIGS. 6 and 7 in which a swung door 68 is disposed beneath the plane of the conveyor and hence beneath the track. In this embodiment the swinging door 68 is pivotally connected to a lower member 72 of the frame 16 at a hinge 70 while a door closer 20 is provided to swing the door in the clockwise sense about this hinge into its closed position as shown in broken line in FIG. 6.

The retaining means 74 here includes the electromagnet 76 which is mounted upon the stationary track section 6. The electromagnet 76 cooperates with a counter plate 78 of the door 68 in the manner described.

In the embodiment of FIGS. 6 and 7, moreover, the movable track section 80 is a single piece and is guided, at its end turned towards the wall, on ramps 84 of the stationary track section 8 upwardly. Lateral guide formations 86 prevent the movable track section from slipping off these ramps. As can be seen from FIG. 6, in broken lines, moreover, the movable track section 80 is shifted to the right over the stationary track section 8 as the door is closed. To this end, the movable track section 80 is articulated to the door 68 at its left hand end, the articulation being constituted by a roller 88 which rides in a longitudinal guide 90 of the door 68. The guide 90 receives the shiftable body 92 formed with two rolling members (FIG. 7) which is biased by a coil spring. The coil spring 100 thus provides a retaining device represented generally at 98 and tending to swing the assembly into the working position shown in solid lines in FIG. 6.

The spring 100 is so dimensioned that in a closed position of the door 68, the spring is held partially compressed by the weight of the movable track section 80 so that the door 68 is retained closed and held so that its flange overlaps the frame 16.

The door 68 operates similarly to the door 12 and as previously described so that, after the emergency has passed, the door 68 can be manually swung in the counterclockwise sense to restore the assembly to its open position.

Figures 8, 9:
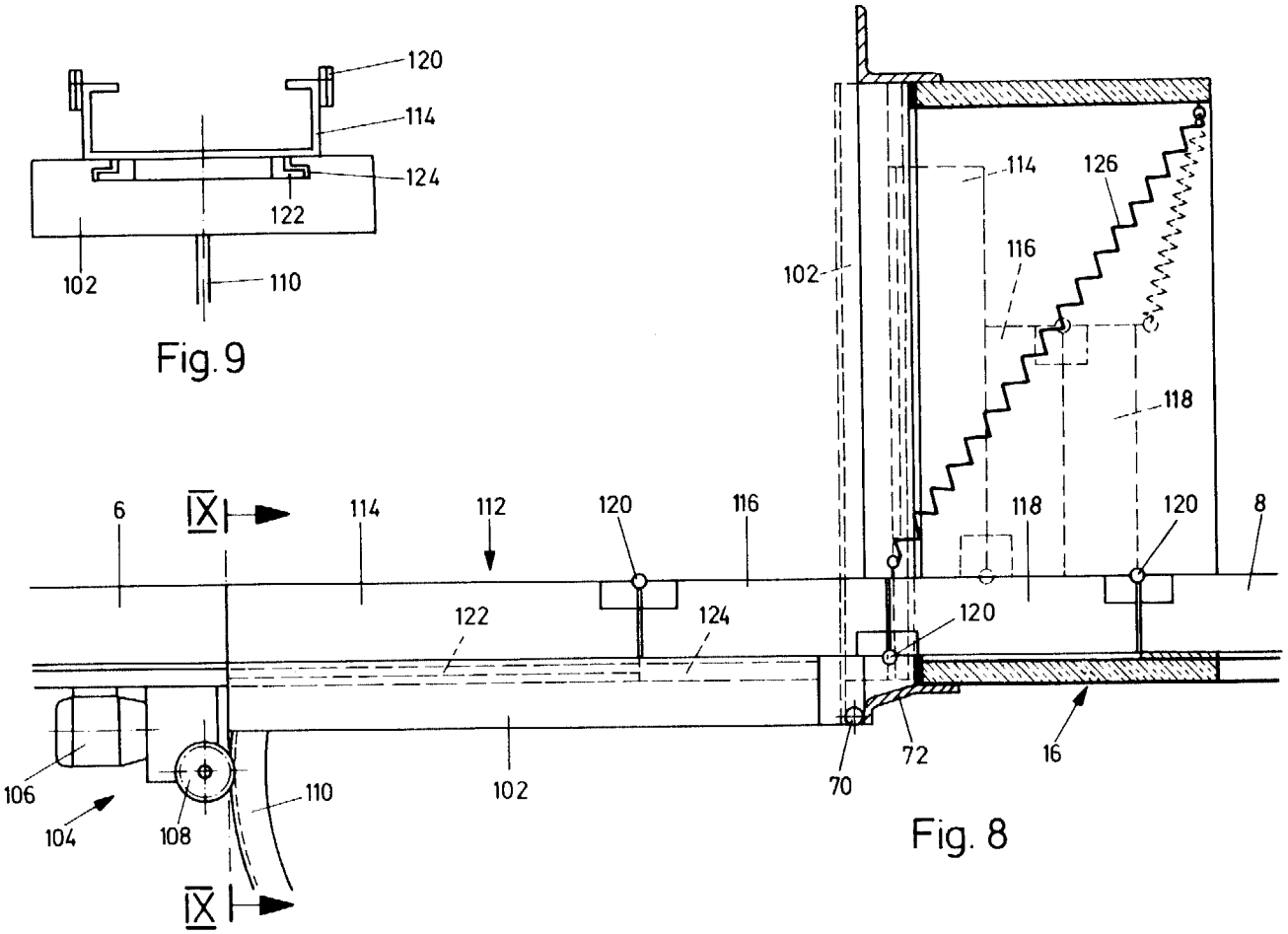
FIG. 8 is a view similar to FIG. 6 illustrating yet another embodiment of the invention.
FIG. 9 is a section along the line IX—IX of FIG. 8.

The embodiment of FIGS. 8 and 9 represents a further isolating arrangement according to the invention with a swinging door 102 pivotally mounted below the track plane. In this embodiment, however, for both opening and closing of the swinging door 102, a drive device 104 with a drive motor 106 is provided. The motor has a gear 108 meshing with an arcuate rack 110. The motor 106 is preferably self blocking so that it can also serve as the retaining device holding the door in each of its two operative positions. In this embodiment, as in the other embodiment, a door closer can be provided in addition to swing the door into its closed position in the event of an emergency. In this case, a magnetic clutch can be provided between the motor and the door to enable the door closure to be effective for this purpose.

In this embodiment, the movable track section 112 comprises three articulated segments 114, 116, 118 whose pivots can be seen at 120 and disposed so that these segments can be folded in a zigzag fashion as shown in broken lines within the opening.

The segment 114 most remote from the stationary section 8 is slidable on the door 102.

As can be seen from FIG. 9, this segment has outwardly and inwardly projecting formations 122 which engage in guide recesses 124 of the door.

A spring 126 draws the segment 118 in the clockwise sense upon door closure, thereby swinging segment 116 in the counterclockwise sense and causing segment 114 to slide along the door 102. This frees the upper edge of the door so that it can overlap the frame 16 in the closed position of the assembly.

Because the segment 114 is coupled to the door 102 in the manner described, the opening of the door automatically draws the movable track section out into its operative position.

I claim:

1. An isolating apparatus for an opening in a wall traversed by a conveyor track, comprising:

a door adapted to close said opening;

hinge means for swingably mounting said door adjacent said opening for displacement of said door from an open position wherein said door extends generally in the direction of said track into a closed position wherein said door closes said opening and lies perpendicular to said direction;

a movable section of said track adjacent said opening between fixed sections of said track, said movable section being shiftable in said direction to clear a path for said door; and coupling means connecting said door to said movable section for displacing same in said direction as said door is displaced between said positions, said door being swingably mounted above said track.

2. An apparatus defined in claim 1, further comprising drive means operatively connected to said door for opening and closing same.

3. An apparatus defined in claim 1, further comprising a door closer connected with said door and prestressed to shift said door into a closed position, and retaining means for releasably retaining said door in its open position against the prestress of said door closer.

4. An isolating apparatus for an opening in a wall traversed by a conveyor track, comprising:

a door adapted to close said opening;

hinge means for swingably mounting said door adjacent said opening for displacement of said door from an open position wherein said door extends generally in the direction of said track into a closed position wherein said door closes said opening and lies perpendicular to said direction;

a movable section of said track adjacent said opening between fixed sections of said track, said movable section being shiftable in said direction to clear a path for said door; and coupling means connecting said door to said movable section for displacing same in said direction as said door is displaced between said positions, said movable section being provided with means enabling same to ride up over a stationary track section, said stationary track section being provided with a ramp upon which said movable track section rides.

5. An isolating apparatus for an opening in a wall traversed by a conveyor track, comprising:

a door adapted to close said opening;

hinge means for swingably mounting said door adjacent said opening for displacement of said door from an open position wherein said door extends generally in the direction of said track into a closed position wherein said door closes said opening and lies perpendicular to said direction;

a movable section of said track adjacent said opening between fixed sections of said track, said movable section being shiftable in said direction to clear a path for said door; and coupling means connecting said door to said movable section for displacing same in said direction as said door is displaced between said positions, said movable track section being formed as a plurality of articulated track segments and said movable track section is folded within said opening as said door is swung into its closed position.

6. An apparatus defined in claim 5, further comprising a spring acting upon said segments for enabling the folding of said movable track section in said opening.

7. An apparatus defined in claim 6 wherein three such segments are provided and are folded in a zigzag configuration.

8. An apparatus defined in claim 5 wherein said coupling means is constructed and arranged to fold said movable track section.

9. An apparatus defined in claim 8 wherein said coupling means includes a cable connecting said movable track section and said door.

10. An apparatus defined in claim 8 wherein said coupling means includes bars on one of said segments and on said door and a link pivotally connected to said bars.

11. An apparatus defined in claim 8 wherein said coupling means includes a longitudinal guide on said door and means connected to one of said segments and riding in said guide.

12. An apparatus defined in claim 5, further comprising means between said segments for urging same into an unfolded operating position.

13. An apparatus defined in claim 12 wherein the last mentioned means includes a hinge drum between two such segments and a spiral spring on said hinge drum extending to a stationary track section.

* * * * *

REEXAMINATION CERTIFICATE (466th)

United States Patent [19]

Schmidt

[11] B1 4,497,254

[45] Certificate Issued Feb. 11, 1986

[54] ISOLATING DEVICE FOR AN OPENING TRAVERSED BY CONVEYOR CARS

[75] Inventor: Siegfried Schmidt, Olching, Fed. Rep. of Germany

[73] Assignee: Büropatent AG, Glarus, Switzerland

Reexamination Request:
No. 90/000,776, May 10, 1985

Reexamination Certificate for:

| | |
|---|---|
| Patent No.: | **4,497,254** |
| Issued: | **Feb. 5, 1985** |
| Appl. No.: | **421,396** |
| Filed: | **Sep. 22, 1982** |

[30] Foreign Application Priority Data

Oct. 7, 1981 [CH] Switzerland ..... 6434/81

[51] Int. Cl.[4] ..... B61B 12/00; E06B 7/00; E01B 23/00

[52] U.S. Cl. ..... 104/1 R; 49/69; 198/950; 238/10 R

[58] Field of Search ..... 432/56, 241; 126/335; 104/1 R, 1 B, 88, 93, 100, 103; 198/950; 49/68, 69, 262; 414/154; 238/10 R

[56] References Cited

FOREIGN PATENT DOCUMENTS 2543744 4/1977 Fed. Rep. of Germany ..... 49/68
292967 12/1981 Fed. Rep. of Germany .

*Primary Examiner*—Randolph A. Reese

[57] ABSTRACT

An isolating device for an opening in a wall traversed by a track for vehicles of a conveyor system. A door can swing up or down to close this opening and a removable track section can be drawn in the direction of the track to clear a path for the door.

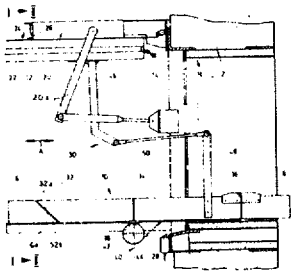

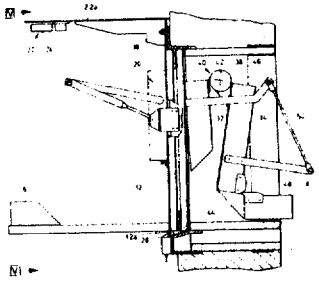

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 4–13 is confirmed.

Claims 1–3 are cancelled.

* * * * *